US010675528B2

(12) United States Patent
Rafiq et al.

(10) Patent No.: US 10,675,528 B2
(45) Date of Patent: Jun. 9, 2020

(54) CONFIGURABLE CUE STICK

(71) Applicants: Desert Cues Pty Ltd, Willetton (AU); Mark Spaile, Little Bay (AU); Ahmed Rafiq, Chifley (AU)

(72) Inventors: Ahmed Rafiq, Chifley (AU); Mark Spaile, Little Bay (AU); Robert Vudrag, Willetton (AU); Guan Qun Hao, Willetton (AU)

(73) Assignee: Desert Cues Pty Ltd, Willetton (AU)

( * ) Notice: Subject to any disclaimer, the term of this patent is extended or adjusted under 35 U.S.C. 154(b) by 0 days.

(21) Appl. No.: 16/242,495

(22) Filed: Jan. 8, 2019

(65) Prior Publication Data

US 2019/0209915 A1 Jul. 11, 2019

(30) Foreign Application Priority Data

Jan. 8, 2018 (AU) ..... 2018900043

(51) Int. Cl.

| | |
|---|---|
| ***A63D 15/08*** | (2006.01) |
| ***A63B 53/14*** | (2015.01) |
| ***A63B 53/08*** | (2015.01) |
| ***A63B 59/00*** | (2015.01) |

(52) U.S. Cl.

CPC ..... *A63D 15/08* (2013.01); *A63B 53/08* (2013.01); *A63B 53/14* (2013.01); *A63B 59/00* (2013.01)

(58) Field of Classification Search

CPC ..... A63D 15/08

See application file for complete search history.

(56) References Cited

U.S. PATENT DOCUMENTS

| | | | | |
|---|---|---|---|---|
| 861,158 | A | 7/1907 | Bucknum | |
| 1,705,353 | A | 3/1929 | Barrett | |
| 2,838,310 | A * | 6/1958 | Redka | A63B 65/08 473/590 |
| 3,372,932 | A * | 3/1968 | Molis | A63D 15/08 473/2 |
| 3,462,147 | A * | 8/1969 | Emanuel | A63D 15/08 403/343 |
| 5,267,730 | A | 12/1993 | Keaggy | |
| 6,881,153 | B2 | 4/2005 | Andrews | |
| 7,179,174 | B2 | 2/2007 | Chang | |

(Continued)

FOREIGN PATENT DOCUMENTS

| | | |
|---|---|---|
| CN | 2868358 Y | 2/2007 |
| CN | 201791351 U | 4/2011 |

*Primary Examiner* — Jeffrey S Vanderveen

(74) *Attorney, Agent, or Firm* — Fitch Even Tabin & Flannery LLP

(57) ABSTRACT

A configurable butt for a cue stick comprising a body comprising an elongate chamber having an internal thread and a movable weight coaxially located within the elongate chamber and having an external thread, the movable weight being threadingly coupled to the internal thread of the elongate chamber. An internal shaft extends through the movable weight is adapted to rotate the movable weight within the internally threaded chamber thereby causing the movable weight to move between respective ends of the elongate chamber by virtue of the threaded coupling for adjusting a centre of gravity of the cue stick. An indicator arrangement is coupled to the internal shaft and adapted to provide an indicate of the location of the movable weight within the elongate chamber.

8 Claims, 8 Drawing Sheets

(56) References Cited

U.S. PATENT DOCUMENTS

| | | | | |
|---|---|---|---|---|
| 2004/0142754 | A1* | 7/2004 | McKevitt | A63D 15/08 473/44 |
| 2005/0043107 | A1* | 2/2005 | Kuo | A63D 15/08 473/44 |
| 2009/0111596 | A1* | 4/2009 | Owen | A63D 15/08 473/47 |

* cited by examiner

CONFIGURABLE CUE STICK

CROSS-REFERENCE TO RELATED APPLICATION

This application claims the benefit under 35 U.S.C. § 119 of Australian Patent Application No. 2018900043, filed Jan. 8, 2018, which is hereby incorporated by reference in its entirety.

FIELD OF INVENTION

The present invention relates generally to a configurable cue stick for use in sports, such as snooker, billiards and/or pool.

BACKGROUND OF INVENTION

Cue sticks are used in sports such as snooker, pool and billiards for striking a cue ball. Cue sticks are long rods comprised of a butt, shaft and tip that can be of various weights, lengths and thicknesses. They can also be formed of numerous different materials, including wood, graphite, carbon fibre or fiberglass. Generally, cue sticks have a uniform taper beginning at the butt and narrowing towards the tip.

Conventionally, cue sticks were formed as a single piece comprising the butt, shaft and tip. More recently, however, modular cue sticks have become popular. A typical modular cue stick is formed of a butt portion and a shaft portion that are coupled together by way of a screw thread. This modularity facilitates not only portability (i.e. allowing the stick to be disassembled and assembled as required), but also provides a certain degree of configurability. For example, a player may carry two or three different butts that each have a different weight and/or shape profile, for use with one or more shaft portions, and vice versa. This allows a player to select a cue stick configuration that suits a particular type of game, a particular type of shot (e.g. a short cue may be used for playing a shot in a confined space, while a longer cue stick may provide more accuracy for a longer shot) or for suiting their game play on any given day (i.e. without needing to buy numerous single piece pool cues for achieving the same variability).

U.S. Pat. No. 1,705,353 discloses a pool cue with a threaded rod that has a weight which can be adjusted to alter the balance of the pool cue. An object of the patent is to provide an improved cue so constructed that all cues may be manufactured of the same initial weight. An adjustable weight is disposed in a body of the cue so that the balance in the cue may be varied at will by adjusting the weight in a direction lengthwise of the cue. The weight of the cue can be determined by the size of the balance weights, thereby reducing the cost of manufacture and obviating the necessity of producing a great variety of cues varying in weights and balances. However, a notable disadvantage with the pool cue proposed by U.S. Pat. No. 1,705,353 is that the location of the weight is unknown, bar from the feel of the cue. When users have one or more favoured balances they need to alternate between these depending on the playing situation. The proposed cue does not allow for these balances to be accurately altered, increasing the time spent determining the exact favoured balance position for the present situation. Further, when striking the ball, the proposed weight would cause vibrations and unwanted effects to occur, decreasing the accuracy of a shot as well as adding unnecessary wears to the cue and loss of confidence by the proposed player.

SUMMARY OF INVENTION

According to a first aspect of the invention there is provided configurable butt for a cue stick comprising: a body comprising an elongate chamber having an internal thread; a movable weight coaxially located within the elongate chamber and having an external thread, the movable weight being threadingly coupled to the internal thread of the elongate chamber; an internal shaft extending through the movable weight and being adapted to rotate the movable weight within the internally threaded chamber thereby causing the movable weight to move between respective ends of the elongate chamber by virtue of the threaded coupling for adjusting a centre of gravity of the cue stick; and an indicator arrangement coupled to the internal shaft and adapted to provide an indication of the location of the movable weight within the elongate chamber.

In an embodiment the indicator arrangement comprises: an internally threaded body which is threadingly coupled to the internal shaft, the body comprising an indicator which is visible externally of the butt.

In an embodiment the internal shaft is adapted to receive a tool for rotating thereof.

In an embodiment the internal thread of the indicator body is tighter than the internal thread of the elongate chamber.

In an embodiment the movable weight comprises at least one wear pad disposed therein and wherein the at least one wear pad does not carry an external thread.

In an embodiment the body is adapted to receive a cue stick shaft with a tip.

In an embodiment the tip is adapted to engage with a ball.

In an embodiment the movable weight comprises: a forward portion; a rear portion; and a spring disposed in a chamber created between opposing voids defined in opposing ends of the forward and rear portion and which acts to maintain a separating force between the forward and rear portion.

In a further embodiment the forward portion is longer than the rear portion.

According to an alternate aspect of the invention there is provided an adjustable cue for use in cue sports comprising: a butt portion and a shaft portion separated by a collar; the collar comprising a stationary member and a rotatable member, wherein the rotatable member is adapted to be rotated and locked into a final position such that the orientation of the shaft changes based on the final position; and wherein the shaft portion comprises one or more markings.

In an embodiment the butt comprises a grip portion with a chamfered edge.

In an embodiment the rotatable member can be rotated such that a desired orientation of the markings aligns with the grip portion.

In an embodiment the rotatable member is locked into the final position by way of a screw mechanism.

According to an alternate aspect of the invention there is provided an adjustable staff for use in sports comprising: a movable weight mounted on a shaft within a hollow core of the staff and which is movable to adjust a centre of gravity of the staff when said shaft is rotated; and an indicator which is movable when said shaft is rotated to display a relative location of the movable weight and thereby the centre of gravity of the adjustable staff.

In an embodiment the thread is coupled to the shaft within the hollow core.

BRIEF DESCRIPTION OF DRAWINGS

Embodiments of the present invention will now be described, by way of example only, with reference to the accompanying drawings, in which.

DETAILED DESCRIPTION

Embodiments of the invention described herein relate to a configurable cue stick for use in cue-ball based sports, such as pool, snooker and billiards. The configurable cue stick comprises a butt which is detachably mounted to a shaft via a threaded coupling. An internally threaded elongate chamber disposed within a body of the butt threadingly receives a movable weight (i.e. that has an external thread disposed thereon). The movable weight is rotatable within the elongate chamber by way of an internal shaft. Rotation of the internal shaft causes the movable weight to move between respective ends of the elongate chamber for manipulating the weight distribution of the cue, allowing a player to set a desired balance point for their playing technique. An indicator arrangement is further coupled to the internal shaft and is configured to provide an indication of the location of the movable weight within the elongate chamber.

Figure 1:
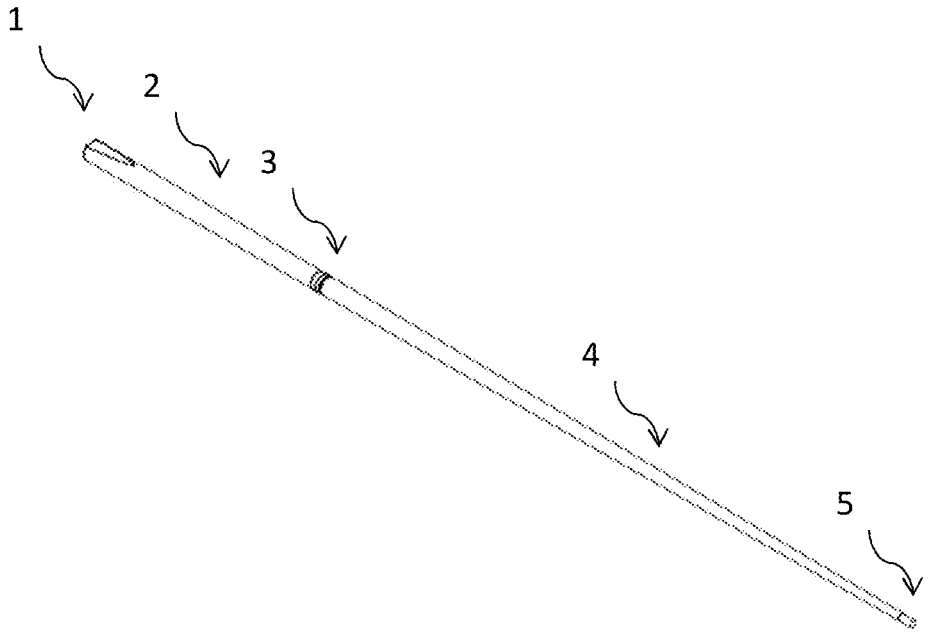
FIG. 1 is a perspective view of an adjustable cue stick, in accordance with an embodiment of the invention.

FIG. 1 depicts a perspective view of a first embodiment of the configurable cue (1). As shown, the cue (1) comprises a butt (2) threadingly coupled to a shaft (4) via a collar (3). The shaft (4) has a tip (5), which is adapted to strike a ball. The butt (2) and collar (3) are adapted to separate from the shaft (4).

Figure 2:
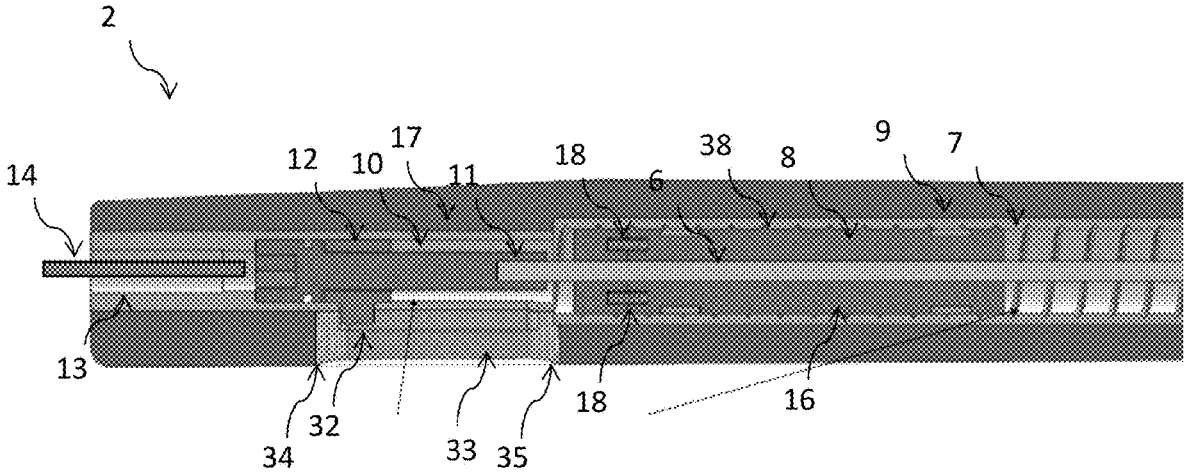
FIG. 2 is a cross sectional partial view of a butt of an adjustable cue stick according to an embodiment of the present invention.

FIG. 2 is a cross sectional partial view of a butt (2) of a configurable cue (1), in accordance with an embodiment of the invention. An internal shaft (6) is co-axially located within an elongate weight chamber (7) disposed within a body of the butt (2). The internal shaft (6) has a square cross-sectional profile and extends the length of the weight chamber (7) and partially into an indicator chamber (17). A movable weight (8) is also co-axially located within the weight chamber (7). The internal shaft (6) passes through a hollow core of the movable weight (8) and is adapted to rotate the movable weight (8) within the chamber (7). More specifically, the hollow core has a square cross-sectional profile that mirrors the shape of the internal shaft (6), but which is slightly larger in size so as to slidingly receive the shaft (6).

According to the illustrated embodiment, the elongate chamber (7) comprises an internal thread (9) that co-operates with an external thread (38) disposed on the movable weight for facilitating movement of the weight (8) along the chamber (7). More specifically, in use, the internal shaft (6) can be rotated clockwise or anti-clockwise to move the movable weight (8) to a desired position within the elongate chamber (7) for adjusting the weight distribution to achieve a desired balance point.

Figure 3:
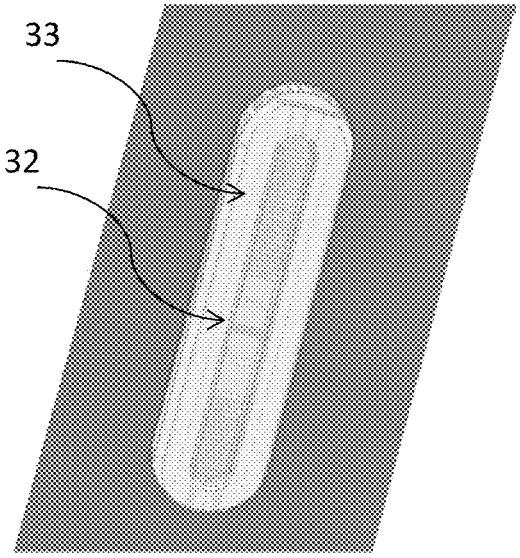
FIG. 3 is an external view of an indicator in accordance with an embodiment of the invention.

As previously mentioned, an extension of the internal shaft (6) extends into an indicator chamber (17) disposed in the butt (2). In more detail, the extension has a circular cross section and has a threaded outer surface (10). A cylindrical indicator body (12) is threadingly located over the threaded outer surface (10) of the internal shaft extension. A projecting indicator portion (32) extends from the indicator body (12) into an externally visible indicator region (33) of the butt (2). The threaded configuration is such that when the movable weight (8) is located at a distal end of the butt (2) the indicator region (33) is located at a first end (34) of the indicator region (33). Correspondingly, when the movable weight (8) is located at a proximal portion of the butt (2), the indicator region (33) is located at an opposite end (35) of the indicator region (33). Thus, in use, the projecting indicator portion (32) displays a relative location of the movable weight (8) and thereby the current weight distribution of the adjustable cue (1). A distinct advantage arising through the indicator arrangement is that particular weight distribution settings can be recognised, recorded and readily set for any given player, game or to suit a current playing technique. FIG. 3 is a view of the indicator region (33) which is visible from an underside of the butt (2).

According to the illustrated embodiment, the threaded portion (10) has a tighter thread than the threaded portion on the movable weight (8), thereby allowing the movable weight (8) to move a greater distance along the butt (2) than the indicator portion (32) and in turn allowing for both the indicator arrangement (10, 12, 32) and the movable weight (8) within the butt (2).

The elongate indicator chamber (17) of the butt (2) extends into an opening (13) at the distal end of the butt (2) for providing access to the internal shaft (6). In an embodiment of the invention, the extension of the internal shaft (6) terminates short of the opening (13) and includes a tool receiving portion at its end. In a particular embodiment, the tool receiving portion is shaped to receive an alien key (14) (although it will be understood that other tool receiving configurations could equally be applicable, such as for receiving a star or flat headed screwdriver). In use, a player is able to insert the tool through the opening (13) and into the tool receiving portion for rotating the internal shaft (6), as previously described.

Figure 4:
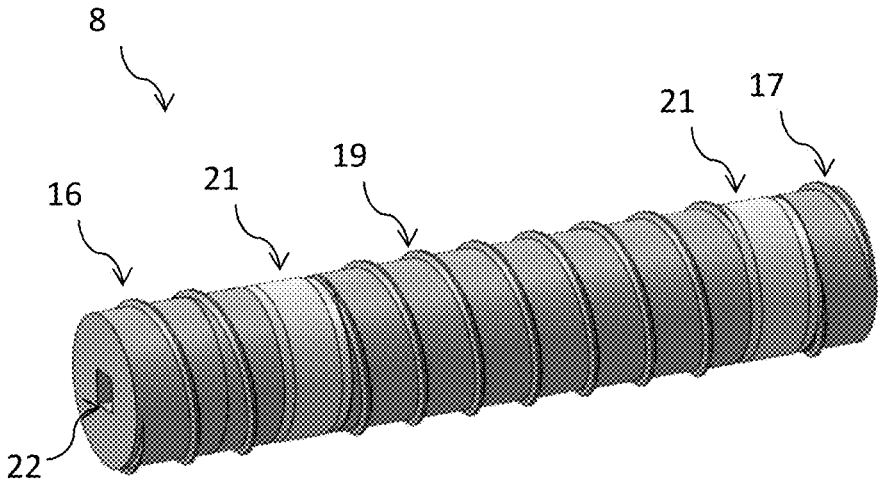
FIG. 4 is a perspective view of a movable weight in accordance with an embodiment of the present invention.

FIG. 4 is a perspective view of a movable weight (8) in accordance with an embodiment of the invention. The movable weight (8) comprises a forward portion (16) and a read portion (17). The movable weight (8) further comprises wear pads (21) that are formed of plastic and operate to assist in absorbing part of the impact force when striking a ball. In the present embodiment, the wear pads (21) are not threaded. However, in alternate embodiments the wear pads (21) may be threaded. There may be one or more wear pads (21) on the movable weight (8).

The movable weight (8) has a square internally disposed channel (22) for snugly receiving the square internal shaft (6), in turn minimising rattling of the weight (8) and thus the adjustable cue (1).

Figure 5:
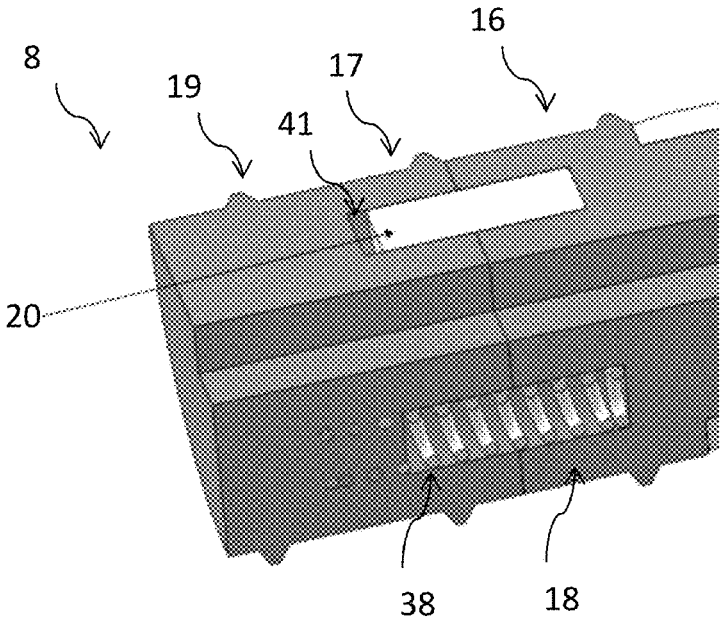
FIG. 5 is a cross-sectional of a partial quadrant of the movable weight of FIG. 4.

FIG. 5 is a cross-sectional view of a partial quadrant of the movable weight (8) shown in FIG. 3. As previously discussed, the movable weight (8) comprises a forward portion (16) and a rear portion (17). The portions (16, 17) are aligned by two pins (20) located in respective pin chambers (41) formed by opposing voids in the respective portions. The pins (20) are made to a close tolerance to prevent any rocking. A compressed spring (18) is housed within a spring chamber (38) formed by voids disposed in opposing ends of the forward portion (16) and rear portion (17). The compressed spring (18) acts to impart a separating force on the respective portions (16, 17) which in turn causes the thread (19) on the respective portions (16, 17) to impart opposing bearing forces on the internal thread (9) of the weight chamber (7). The force imparted on the rear portion (17) removes backlash, while the force imparted on the front portion prevents ratline rattling when hitting the ball. Further, the rear portion (17) has enough preload (by virtue of the spring) to ensure it is always pushed against the threads to the rear even during impact force. Although not visible in FIG. 4, a second spring is located on the opposing quadrant of the weight (8), as can be seen in FIG. 2.

The forward portion (16) is longer than the rear portion (17) thereby assisting in reducing backlash, as well as providing suitable preload to the smaller rear portion (17). The preload allows the rear portion (17) to be pushed against the thread (19) on the rear portion (17) to the rearmost of the butt (2). This is advantageous in reducing the impact force when striking a ball.

Figure 6:
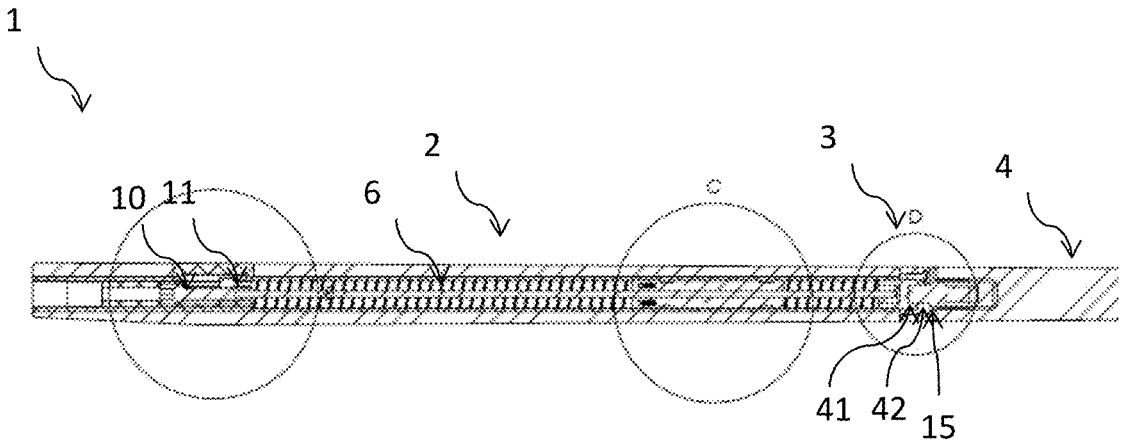
FIG. 6 is a partial cross-sectional view of an assembled cue, in accordance with an embodiment of the invention.

FIG. 6 is a partial cross-sectional view of an assembled cue (1) in accordance with an embodiment of the invention. The butt (2) and shaft (4) are joined by way of a collar (3). The collar (3) is adapted to receive the shaft (4) via a screw fit and is secured via a fixing means (15), in this instance a screw which can be tightened using a screw driver. Typically, a player has no control over setting the alignment of the markings on the shaft once the shaft has been tightly screwed to the butt.

Figure 7:
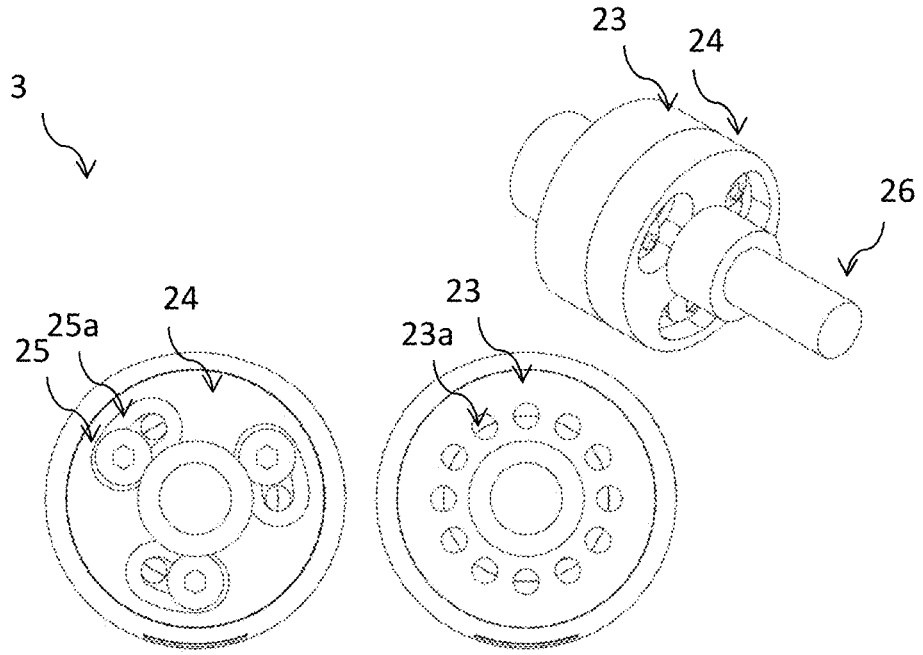
FIG. 7 are multiple engineering views of a collar in accordance with an embodiment of the invention.
Figure 8:
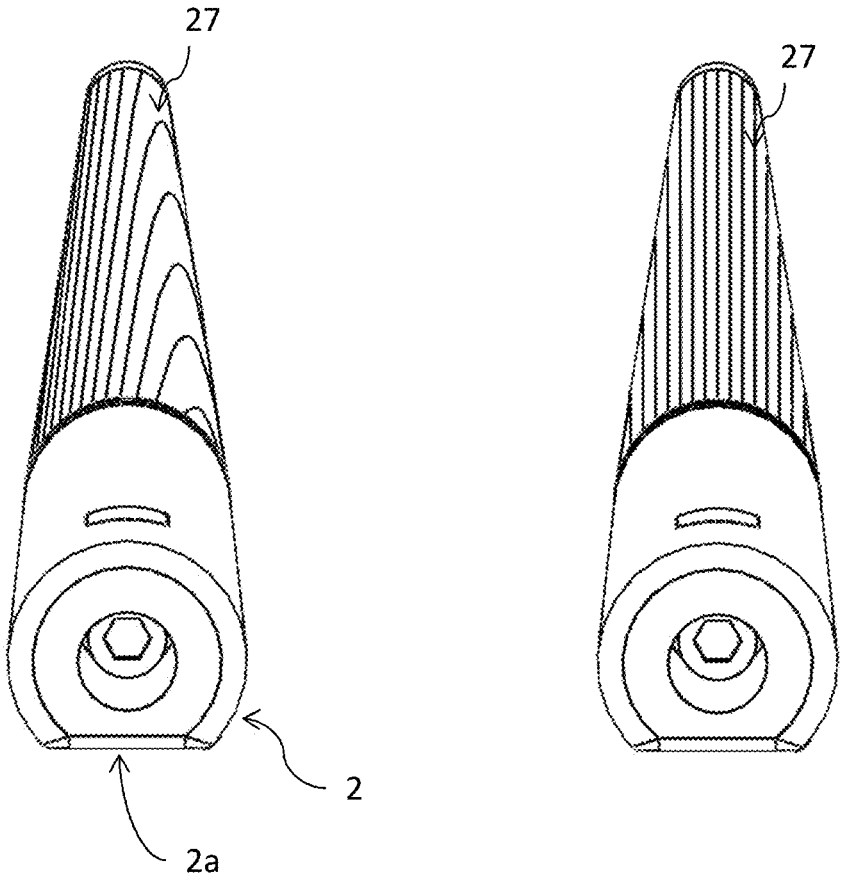
FIG. 8 is a perspective view of markings in accordance with an embodiment of the invention.

FIG. 7 is a close-up view of section D shown in FIG. 6 and illustrates multiple views of a rotatable alignment collar (3) in accordance with an embodiment of the invention. The collar (3) is located at a proximal end of the butt (2) and comprises a stationary member (23) coupled to a rotatable member (24) which is in turn coupled to a threaded shaft (26). The threaded shaft (26) is used for screwing the shaft (4) to the butt (2) in a conventional manner. The stationary member (23) is affixed to the body of the butt (2) and includes multiple alignment holes (23*a*) located in a circular formation around a centre of the stationary member (23). As shown in FIG. 6, a cylindrical shaft (41) projects inwardly from the rotatable member (24) for seating in a correspondingly shaped void (42) disposed in the stationary member (23) and allows rotation of the rotatable member (24) relative to the stationary member (23) (i.e. about the same centre axis). Once a desired rotatable alignment has been achieved (as explained in the subsequent paragraph), the rotatable member (24) is locked into position by way of one or more screws (25) that are adapted to pass through locking regions (25*a*) in the rotatable member (24) and screw into correspondingly aligned threaded alignment holes (23*a*) in the stationary member (23). The stationary member (23) may be affixed to the body of the butt (2) by way of screws, glue or other suitable means. An advantage of the rotatable collar (3) is that the cue stick shaft (4) can be set in any desired rotatable alignment with the butt (2) when in assembled form. By way of example, and with additional reference to FIG. 8, the butt (2) may comprise a grip portion, being a chamfered edge (2*a*) that a user can comfortably hold to increase their grip. In use, the grip portion typically faces upwards. Further, the shaft (4) may comprise one or more markings (27), such as natural wood grain markings or other alignment indicators. The rotatable collar (3) may be set to ensure that when the shaft (4) is tightly screwed to the butt (2) the markings are in a desired orientation when a grip portion of the butt is suitably aligned. This may allow a player to increase their accuracy when determining an angle at which to strike the ball, as they have an increased awareness of the position of the adjustable cue (1). As shown in FIG. 8, the left view is of a shaft prior to alignment, and the right view is after alignment.

In an alternate embodiment of the invention, the markings (27) may be artificially added to the shaft (4), such as being painted on.

In an embodiment of the invention, the elongate weight chamber (7) extends substantially the length of the butt (2) to allow for the balance point to be widely varied.

A person skilled in the art would appreciate that the butt (2) and shaft (4) may or may not be coupled by way of a collar (3). In an alternate embodiment, the butt (2) and shaft (4) are coupled to each other directly. There are numerous mechanisms that are able to couple the butt (2) and shaft (4) that do not depart from the nature of the invention, for instance, via a screw fit, glue, friction fit, etc. The butt (2) and shaft (4) may be removably coupled or may be fixed to each other. In some embodiments, the butt (2) and shaft (4) are unitary and formed of the same material.

A person skilled in the art would appreciate that the adjustable cue (1) can be of any length or width, depending on the preference of the maker and user. The adjustable cue (1) may also be made of any material, such as wood, plastic fibreglass, metal, etc or a combination of materials.

The movable weight (8) can be of any weight such that it does not depart from the nature of the invention, for instance between 100-200 grams. In an embodiment of the invention the movable weight (8) weighs more than the indicator thread (10) to ensure the centre of gravity is adjustable. In an alternate embodiment, the movable weight (8) is the same size or larger than the indicator thread (10).

The elongate chamber (7) may extend through the entire length of the butt (2), or may only extend through a portion of the butt (2).

A person skilled in the art would appreciate the tool (14) may come in various forms, such as a screwdriver, an alien key etc such that it is able to initiate the movement of the movable weight (8), and indicator thread (10). In an alternate embodiment the tool (14) is not removable and remains within the butt (2) which can be pushed or rotated such that in turn the indicator thread (10) and movable weight (8) are ultimately moved.

In an embodiment of the invention the movable weight (8) does not have springs (18) or pins (20).

The adjustable cue may also be used in a number of sporting equipment other than a cue stick, such as tennis racquet, golf club, badminton racquet, cricket bat or other racquet for use in club sports. In such scenarios the present invention relates to an adjustable staff for use in sports comprising a movable weight mounted on a rod within a hollow core of the staff adapted to adjust a centre of gravity of the staff when said rod is rotated. The staff further comprises an indicator thread coupled to the rod within the hollow core, in use moving an indicator when said rod is rotated to display a relative location of the movable weight and thereby the centre of gravity of the adjustable staff. For example, the staff may be the tennis racquet handle.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

The preceding description is provided in relation to several embodiments which may share common characteristics and features. It is to be understood that one or more features of any one embodiment may be combinable with one or more features of the other embodiments. In addition, any single feature or combination of features in any of the embodiments may constitute additional embodiments.

In addition, the foregoing describes only some embodiments of the inventions, and alterations, modifications, additions and/or changes can be made thereto without departing from the scope and spirit of the disclosed embodiments, the embodiments being illustrative and not restrictive.

Furthermore, the inventions have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realize yet other embodiments.

Further, each independent feature or component of any given assembly may constitute an additional embodiment.

The invention claimed is:

1. A configurable butt for a cue stick comprising:

a body comprising a longitudinally extending elongate chamber having an internal thread;

a movable weight located within the elongate chamber and having an external thread which is threadingly coupled to the internal thread of the elongate chamber;

an internal shaft extending longitudinally through the movable weight and being configured to rotate the movable weight within the internally threaded chamber thereby causing the movable weight to move between respective ends of the elongate chamber to thereby adjust a centre of gravity of the cue stick;

a rotatable end portion disposed at a first end of the body and being coupled to the internal shaft, the rotatable end portion being externally manipulatable for effecting rotation of the internal shaft; and an indicator arrangement configured to provide an externally visible indication of the location of the movable weight within the elongate chamber, wherein the configurable butt is further configured to couple to a tipped cue stick shaft at a second end for providing a completely assembled cue stick and such that, when in the completely assembled state, the rotatable end is externally manipulatable so as to move the movable weight to a desired location for adjusting the centre of gravity of the cue stick.

2. The configurable butt for a cue stick as in claim 1, wherein the indicator arrangement is coupled to the internal shaft and comprises an internally threaded body which is threadingly located over a threaded portion of the internal shaft.

3. The configurable butt as in claim 2, wherein the internal thread of the indicator arrangement has a pitch that is larger than a pitch of the internal thread of the elongate chamber.

4. The configurable butt as in claim 1, wherein the rotatable end portion is configured to receive a tool for facilitating rotation thereof.

5. The configurable butt as in claim 1, wherein the movable weight comprises at least one wear pad disposed therein and wherein the at least one wear pad does not carry an external thread.

6. The configurable butt as in claim 1, wherein the movable weight comprises:

a forward portion;

a rear portion; and a spring disposed in a chamber created between opposing voids defined in opposing ends of the forward and rear portion and which acts to maintain a separating force between the forward and rear portion.

7. The configurable butt as in claim 6, wherein the forward portion is longer than the rear portion.

8. The configurable butt as in claim 1, wherein the butt is configured to be detachably coupled to the cue stick shaft.

* * * * *